United States Patent [19]

Watanabe

[11] Patent Number: 4,465,526

[45] Date of Patent: Aug. 14, 1984

[54] HIGH-COERCIVE-FORCE PERMANENT MAGNET WITH A LARGE MAXIMUM ENERGY PRODUCT AND A METHOD OF PRODUCING THE SAME

[75] Inventor: Kiyoshi Watanabe, Sendai, Japan

[73] Assignee: The Foundation: The Research Institute of Electric and Magnetic Alloys, Sendai, Japan

[21] Appl. No.: 422,368

[22] Filed: Sep. 23, 1982

Related U.S. Application Data

[62] Division of Ser. No. 184,980, Sep. 8, 1980, abandoned.

[30] Foreign Application Priority Data

Oct. 31, 1979 [JP] Japan ..... 54-139896

[51] Int. Cl.[3] ..... H01F 1/02

[52] U.S. Cl. ..... 148/101; 148/121; 148/31.57; 75/123 R; 420/581

[58] Field of Search ..... 420/463, 581; 75/123 R; 148/31.57; 148/101, 102, 120, 121

[56] References Cited

U.S. PATENT DOCUMENTS 1,832,307 11/1931 Kingsbury ..... 75/170
2,226,079 12/1940 Spanner ..... 75/172 R
3,155,467 11/1964 Yamamoto et al. ..... 420/463
4,098,605 7/1978 Nepela et al. ..... 75/123 R

OTHER PUBLICATIONS

Kussman and Muller in "Zeitschrift fur angewandte physik" 1964, vol. 17 No. 7, pp. 509–511.

*Primary Examiner*—John P. Sheehan
*Attorney, Agent, or Firm*—Parkhurst & Oliff

[57] ABSTRACT

The disclosed permanent magnet consists of an iron-palladium alloy consisting of 25 to 40 atomic % of palladium, and the remainder of iron with less than 0.5 atomic % of impurities or an iron-palladium-silver alloy consisting of 19.5 atomic % of palladium, 0.1 to 27.5 atomic % of silver and the remainder of iron with less than 0.5 atomic % of impurities and having a crystalline structure with fine dispersion of $\alpha+\gamma_1$ phase in a matrix, so that the permanent magnet has a coercive force of higher than 500 Oe, a residual magnetic flux density of larger than 6 kG, and a maximum energy product of larger than 2 MG.Oe. The disclosed method of producing the aforementioned permanent magnet comprises steps of homogenizing solid solution treatment at a temperature depending on the specific alloy composition, cooling, and tempering at a suitable temperature so as to generate the aforementioned crystalline structure.

4 Claims, 12 Drawing Figures

HIGH-COERCIVE-FORCE PERMANENT MAGNET WITH A LARGE MAXIMUM ENERGY PRODUCT AND A METHOD OF PRODUCING THE SAME

This is a division of application Ser. No. 184,980 filed Sept. 8, 1980 abandoned.

Background of the Invention

1. Field of the Invention

This invention relates to a permanent magnet consisting of an iron-palladium or iron-palladium-silver alloy with small amount of less than 0.5 atomic % of impurities and a method of producing the same. An object of the invention is to provide a permanent magnet which is easily workable and has a high coercive force and a large maximum energy product.

2. Description of the Prior Art

As a conventional permanent magnet using the $\alpha$-$\gamma'$ transformation, there is a permanent magnet made of Vicalloy (trademark) which is a 52% cobalt-9.5% vanadium-iron system alloy. This system alloy has a $\gamma$ phase at a high temperature and an $\alpha+\gamma'$ phase of ordered lattice at room temperature. Accordingly, when this alloy is subjected to water quenching and then cold working, the $\gamma$ phase is transformed into $\alpha$ phase, and upon tempering, a part of the $\alpha$ phase is transformed into fine $\gamma'$ phase and precipitated as dispersion precipitations, whereby the coercive force thereof is increased. However, the coercive force of the Vicalloy magnet is generally small; namely, its maximum value of coercive force is 500 Oe, and in order to achieve this value of coercive force, a forced cold working of up to about 98% is necessary. Besides, this alloy contains an easily oxidizable element, i.e., vanadium, so that this alloy has short comings in that in its melting process it is difficult to avoid oxidation and the process of making the pemanent magnet from the alloy is complicated.

As an alloy wherein $\gamma$ phase is transformed in $\alpha+\gamma_1$ phase during cooling, an iron-palladium alloy is known. The magnet characteristics of this alloy were disclosed by Kussmann and Müller in "Zeitschrift für angewandte physik" 1964, Volume 17 Number 7, pages 509–511. It was found that when an alloy consisting of 18 to 50 atomic % of palladium and the remainder of iron was quenched from 1,000° C. and tempered at 450° C., the coercive force of the alloy was increased up to 780 Oe. The aforementioned disclosure refers to the coercive force in the main, but it does not provide any detailed description of other magnetic characteristics such as residual magnetic flux density and the maximum energy product.

Summary of the Invention

An object of the present invention is to provide a high-coercive-force permanent magnet having a large maximum energy product, characterized in that the permanent magnet consists of 25 to 40 atomic %, (38.8 to 56 weight %), of palladium and the remainder of iron with less than 0.5 atomic % of impurities, and that the permanent magnet has a crystalline structure with fine dispersion of $\alpha$ phase and $\gamma_1$ phase in a matrix, so as to provide a coercive force of higher than 500 Oe (Oersted), a residual magnetic flux density of larger than 6 kG (kilogauss), and a maximum energy product of larger than 2 MG.Oe (Megagauss.Oersted).

Another object of the present invention is to provide a method of producing a high-coercive-force permanent magnet having a large maximum energy product, characterized in that an alloy consisting of 25 to 40 atomic % of palladium and the remainder of iron with a small amount of impurities is subjected to homogenizing solid solution treatment for a suitable period of 30 minutes to 2,000 hours at 650° C. to 990° C., cooled quickly in water or in air or cooled slowly in a furnace, and then heated for a long period of 30 minutes to 2,000 hours at 350° C. to 440° C., so as to generate fine dispersion of $\alpha+\gamma_1$ phase in a matrix.

Another object of the present invention is to provide a method of producing a high-coercive-force permanent magnet having a large maximum energy product, characterized in that an alloy consisting of 32 to 40 atomic % of palladium and the remainder of iron with a small amount of impurities is subjected to homogenizing solid solution treatment for a suitable period at 650° C. to 990° C., cooled quickly in water or in air, subjected to plastic working such as wire drawing or rolling of more than 90%, and then heated for a long period of 30 minutes to 2,000 hours at 350° C. to 440° C., and cooled at a cooling rate of more than 10° C./hour more specially 2,000° C./sec to 10° C./hour, so as to generate a crystalline structure with fine dispersion in $\alpha+\gamma_1$ phase of the magnet.

A further object of the present invention is to provide an easily workable high-coercive-force permanent magnet having a large maximum energy product, characterized in that the permanent magnet consists of 19.5 to 41 atomic % of palladium, 0.1 to 27.5 atomic % of silver, and the remainder of iron with less than 0.5 atomic % of impurities, which permanent magnet has a crystalline structure of matrix with fine dispersion of $\alpha+\gamma_1$ phase matrix.

A still further object of the present invention is to provide a method of producing an easily workable high-coercive-force permanent magnet having a large maximum energy product, characterized in that an alloy consisting of 19.5 to 41 atomic % of palladium, 0.1 to 27.5 atomic % of silver, and the remainder of iron with less than 0.5 atomic % of impurities is solidified into a desired formed article from a melt thereof, subjected to homogenzing solid solution treatment at 600° C. to 1,200° C., cooled quickly or slowly, and then heated at 350° C. to 550° C., so as to generate a crystalline structure with fine dispersion of $\alpha+\gamma_1$ phase in a mother matrix.

Brief Description of the Drawings

For a better understanding of the invention, reference is taken to the accompanying drawings, in which.

Description of the Preferred Embodiments

Figure 1:
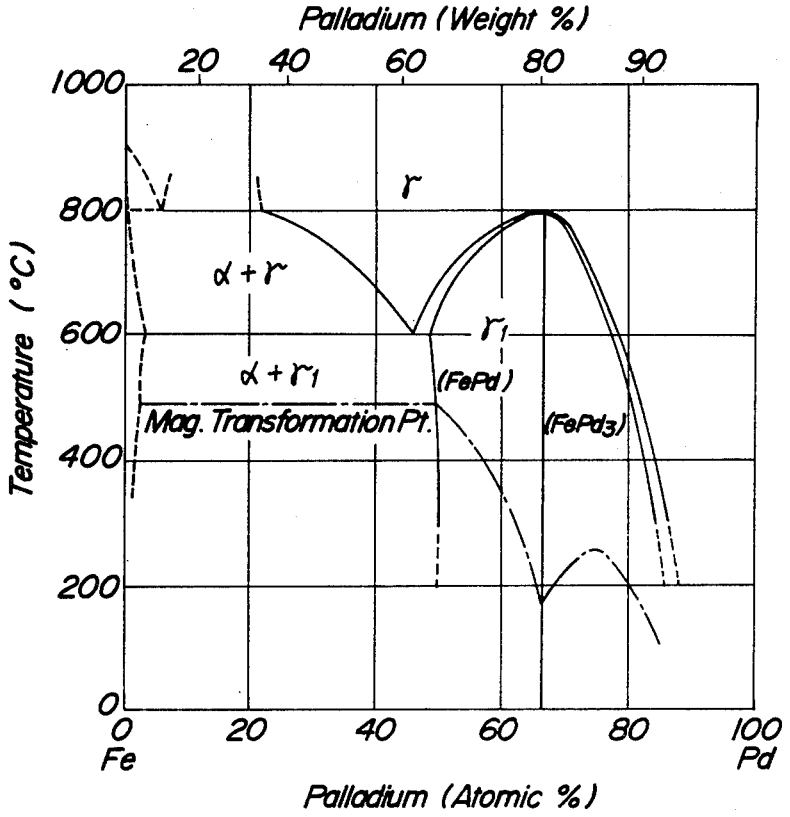
FIG. 1 is an equilibrium diagram of iron-palladium alloys.

The inventors have carried out detailed studies on magnetic characteristics of binary iron-palladium alloys and ternary iron-palladium-silver alloys. As a first case, suitable amounts of starting materials consisting of 25 to 40 atomic % of palladium and the remainder of iron were melted in air, in an inert gas, or in vacuo by using a suitable melting furnace; each of the thus molten melts was thoroughly stirred to produce a homogeneous molten alloy in terms of the chemical composition thereof; a sound cast good was made by pouring the molten alloy into a mold of suitable size and shape or by sucking the molten alloy into a quartz tube; and the cast good was shaped into a desired form by working, such as forging or drawing, at room temperature. Each of the iron-palladium alloys thus shaped was subjected to homogenizing solid solution treatment for a suitable period at a temperature in a range of 650° C. to 990° C., i.e., the temperature range for $\gamma$ phase in the equilibrium diagram of FIG. 1, and the thus treated alloy was cooled quickly in water or in air or cooled slowly in the furnace. Permanent magnets having high coercive forces were tempered from the thus formed alloys by heating for a long period of 30 minutes to 2,000 hours at 350° C. to 440° C., i.e., at a temperature lower than 450° C. and then cooling the thus tempered alloys.

As a second case, the inventor has succeeded in achieving better magnetic characteristics by quickly cooling the aforementioned alloys in water or in air after the aforementioned homogenizing solid solution treatment, applying plastic working, e.g., wire drawing or rolling with an area reduction ratio of more than 90%, on the thus cooled alloys, and then tempering the thus worked alloys for a long period of about 40 to 1,000 hours at 350° C. to 440° C.

To further improve the magnetic characteristics and to reduce the concentration of the expensive metallic palladium in the alloys by adding another element therein, the inventors carried out detailed studies on adding of silver into the iron-palladium alloy. Silver hardly forms a solid solution with iron but almost thoroughly dissolves into a solid solution with palladium.

Consequently, the present invention provides an excellent permanent magnet having a high coercive force in a range of 500 to 1,450 Oe depending on the chemical composition thereof, which coercive force is about two times higher than that obtained by Kussmann et al in a range of 200 to 780 Oe.

The reason for the high coercive force of the permanent magnet of the present invention appears to be in that, the aforementioned homogenizing solid solution treatment at 650° C. to 990° C. provides solid solution of single $\gamma$ phase, regardless of whether the treatment is followed by quick cooling in air or slow cooling in a furnace, and the succeeding tempering at a temperature not higher than 440° C. (preferably 350° C. to 440° C.) for a long period of 40 hours or longer (preferably 40 to 2,000 hours) and cooling at a cooling rate of more than 10° C./hr, more specially 2,000° C./sec to 10° C./hr, produces a crystalline structure having an ordered lattice with fine dispersion of $\alpha$ phase and $\gamma_1$ phase in the matrix, which crystalline structure is transformed from the $\gamma$ phase solid solution formed at the high temperature of the solid solution treatment and causes the high coercive force and the large maximum energy product of the permanent magnet.

If the tempering temperature is higher than 440 C., the magnitudes of the grain of $\alpha$ phase and $\gamma_1$ phase become too large and the aforementioned magnetic characteristics of the permanent magnet deteriorate. On the other hand, if the tempering temperature is lower than 350° C., the tempering time becomes too long to be practically economical without producing any justifiable improvement of the magnetic characteristics. Accordingly, the preferable range of the tempering temperature is between 350° C. and 440° C.

The invention will now be described in further detail by referring to preferred embodiments thereof.

As starting materials, electrolytic iron with a purity of 99.9% and palladium were used. To prepare specimens for experiments, each of the starting materials was weighed so as to produce 10 grams of each specimen with a desired chemical composition of iron-palladium system, and each of the specimens thus weighed was placed in an NC Tammann tube. Each specimen was melted in a Tammann furnace while blowing argon gas thereinto and stirred thoroughly to get a homogeneous molten alloy, and the molten alloy was sucked into a quartz tube of about 3.5 mm diameter. A 30 mm long test piece of each specimen was cut from each of the round rods formed by the quartz tube, which test piece was heated at 750° C. to 990° C. for about one hour and subjected to water quenching and then the following tests were carried out on the test piece.

Figure 2:
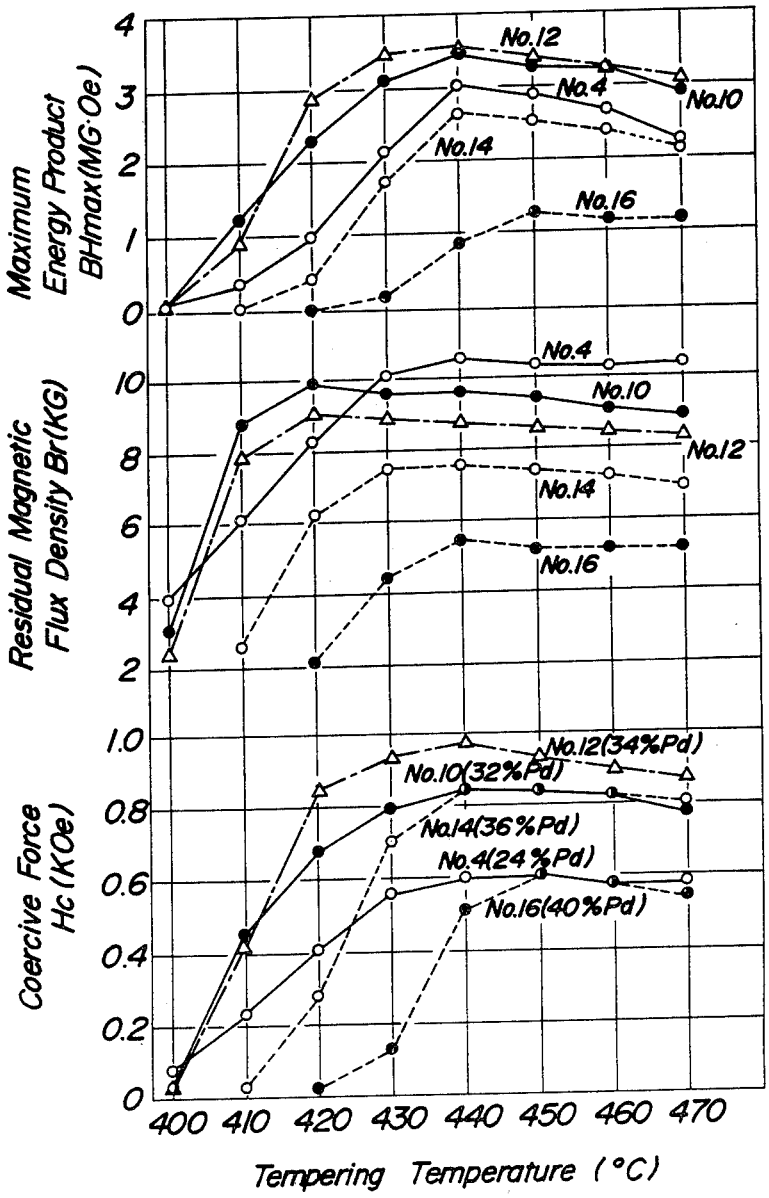
FIG. 2 is a graph showing the relationship between tempering temperatures and magnet characteristics of five iron-palladium alloys to be used in the present invention, which alloys contain 24 to 40 atomic % of palladium.

Alloys of five specimens of different chemical compositions thus heat treated, i.e., Specimens No. 4, No. 10, No. 12, No. 14, and No. 16, were tempered for 20 hours at different temperatures between 400° C. and 470° C. FIG. 2 shows the magnetic characteristics of the five specimens thus tempered. As can be seen from the figure, the coercive forces suddenly increased at a tempering temperature range of 410° C. to 420° C. until reaching maximum values thereof at the tempering temperature of 440° C., and if the tempering temperature exceeded that of the maximum coercive force, the coercive forces generally became smaller. Based on the result of the tempering tests, the inventor has found that tempering for a long period at a comparatively low temperature between 350° C. and 440° C. corresponding to temperatures for initial stages of grain dispersion results in finer grain dispersion structure than those obtained by tempering for a short period at high temperatures in excess of 440° C., and thereby a high coercive force can be achieved.

Figure 3:
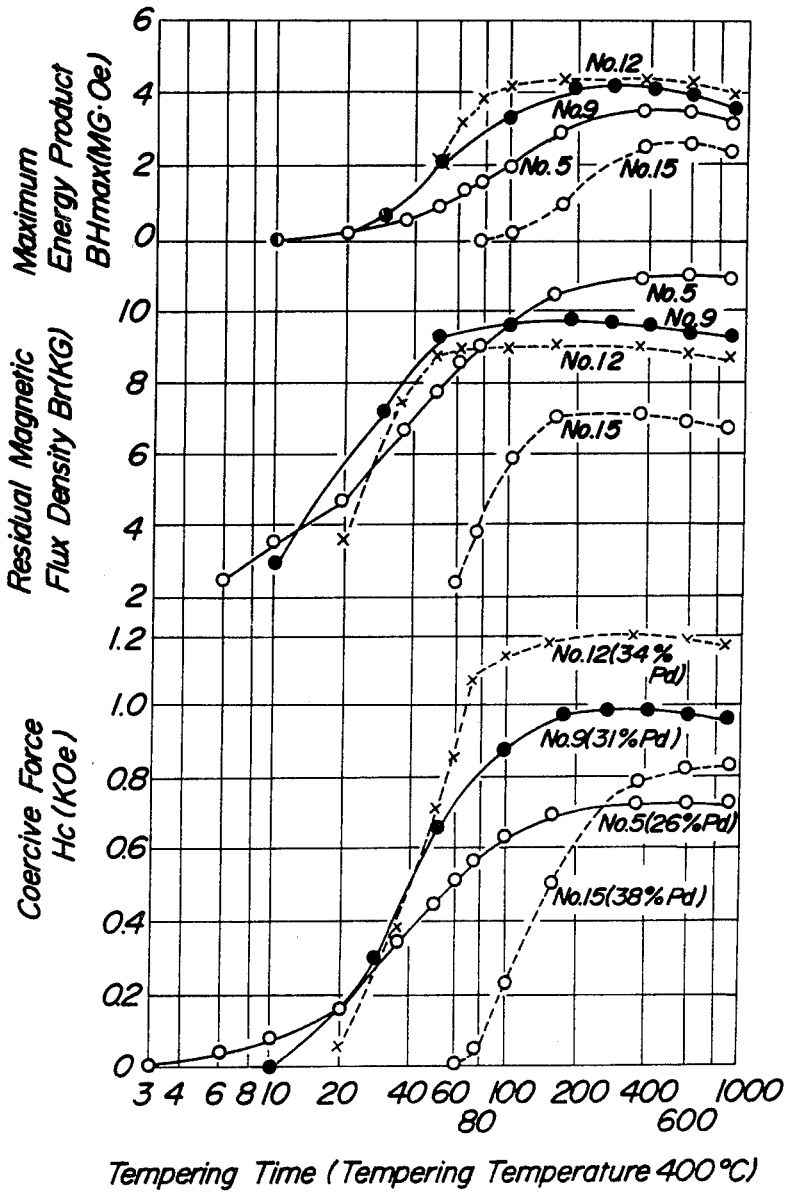
FIG. 3 is a graph showing the relationship between duration of tempering at a constant temperature and magnet characteristics of four typical iron-palladium alloys to be used in the present invention.

Alloys of four speicmens of typical chemical compositions of binary iron-palladium system, i.e., Specimens No. 5, No. 9, No. 12, and No. 15, were water quenched and tempered for a long period at a constant temperature of 400° C. FIG. 3 shows the relationship between the duration of the long period tempering at the constant temperature and the magnetic characteristics obtained thereby. As can be seen from FIG. 3, for the constant tempering temperature of 400° C., keeping the specimens for about 20 hours merely resulted in a slight increase of the coercive force, while tempering for 40 to 60 hours resulted in a rapid increase of the coercive force, and tempering for more than 200 hours resulted in maximum coercive forces. With Specimen No. 12, a high coercive force of 1,200 Oe was obtained by heating for 380 hours. It was noted in the experiments that a constant temperature heating at a higher temperature, i.e., at 450° C., produced a maximum coercive force after about 50 hours of heating but the maximum value of the coercive force was 850 Oe and comparatively low.

Figure 4:
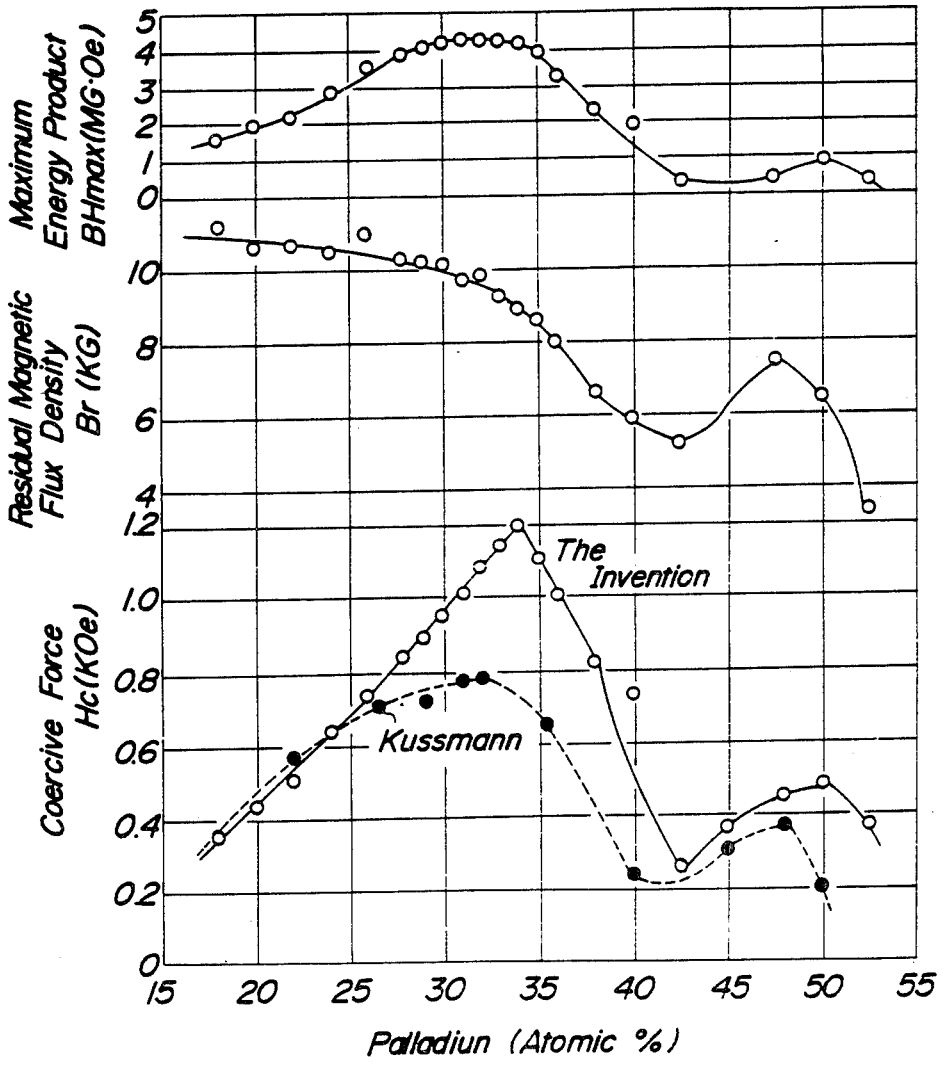
FIG. 4 is a graph showing the relationship between compositions and magnet characteristics of iron-palladium alloys to be used in the present invention, wherein coercive forces reported by Kussmann et al are shown for comparison.

FIG. 4 shows the relationship between the chemical compositions of the iron-palladium alloy and the maximum coercive force of the alloy and between the same chemical compositions and the residual magnetic flux density and the maximum energy product of the alloy, which residual magnetic flux density and maximum energy product were obtained by the aforementioned heat treatments. In FIG. 4, black dots represent coercive forces obtained by Kussmann et al and show that the highest coercive force obtained by Kussmann et al was 780 Oe for an iron-palladium alloy containing 32 atomic % of palladium. On the other hand, the white dots represent the characteristics of the alloys used in the present invention and show that the maximum coercive force obtained by the present invention was 1,200 Oe for an iron-palladium alloy containing 34 atom % of palladium which alloy also had a residual magnetic flux density of 9,000 G and a maximum energy product of 4.2 MG·Oe. As can be seen in this figure, the coercive force of the Kussmann alloys never reaches 800 Oe, while the coercive force of alloys of the invention having about 28 to 36 atomic % of Pd does not fall below 800 Oe. Thus, FIG. 4 shows that the alloys used in the present invention have excellent magnetic characteristics.

Table 1 shows the effects of various manufacturing conditions and heat treatments of typical iron-palladium alloy magnetic materials on magnet characteristics of the permanent magnets produced thereby. As can be seen from the table, high-speed quenching of 2,000° C./sec to 400° C./hr. by quick cooling in water produced slightly higher coercive forces than quick cooling in air, but the difference therebetween was small, and even slow coolings at a rate of 400° C./hour or more than 10° C./hr. also produced very good magnetic characteristics. Accordingly, it was found that, although the magnetic characteristics of regular magnet alloys deteriorated if the magnet alloys were slowly cooled after homogenizing solid solution treatment thereof, the magnet characteristics of the binary alloys used in the present invention were hardly affected by the cooling rate of 2,000° C./sec to 10° C./hr and the actual stability of the magnet characteristics against temperature variations was high. The high stability is another excellent property of the binary alloys used in the present invention.

Figure 5:
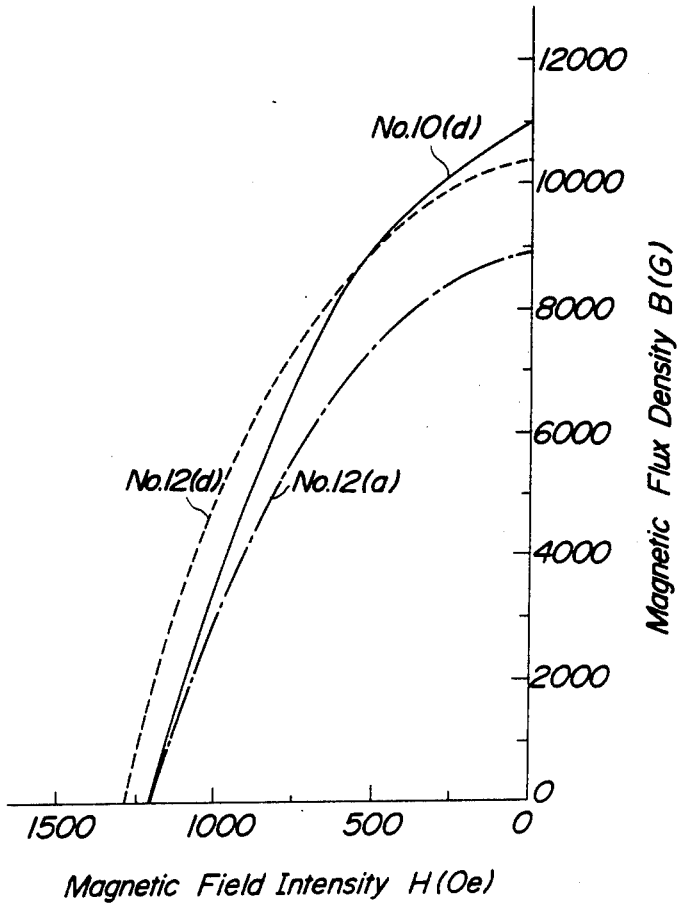
FIG. 5 shows typical demagnetizing curves of Specimens No. 10(d), No. 12(a), and No. 12(d) of the iron-palladium alloys to be used in the permanent magnet according to the present invention.

Table 1 also shows the effects of wire drawing on the magnetic characteristics of the binary alloys used in the invention; namely, the binary alloys of Specimens No. 9, No. 10, No. 12, No. 13, and No. 15 were heated at about 950° C. for one hour, water quenched, subjected to wire drawing at an area reduction ratio of more than about 95%, and then tempered. As can be seen from the table, all the specimens subjected to the wire drawing had improved magnet characteristics. More particularly, the alloys of Specimen No. 13 (containing 35 atomic % of palladium) showed a maximum coercive force of 1,370 Oe simultaneously with a residual magnetic flux density of 9,000 G and a maximum energy produced of 4.78 MG·Oe. The alloy of Specimen No. 12 (containing 34 atomic % of palladium) showed a maximum energy product 5.65 MG·Oe simultaneously with a coercive force of 1,350 Oe and a residual magnetic flux density of 10,800 G. FIG. 5 illustrates demagnetizing curves for alloys of Specimen No. 10 (d: subjected to wire drawing after water quenching). Specimen No. 12 (a: subjected to water quenching), and Specimen No 12(d). The alloys were very easy to work and they were suitable for the manufacture of magnets of specially small size and highly complicated shape.

TABLE 1

| Specimen No. | Composition (atomic %) Iron | Palladium | Quenching* conditions | Tempering conditions Temp. (°C.) | Time (hours) | Magnetic characteristics Coercive force, $H_c$ (Oe) | Residual magnetic flux density, Br (G) | Maximum energy product, (BH) max (Mg.Oe) |
|---|---|---|---|---|---|---|---|---|
| 5 | 74 | 26 | a | 400 | 600 | 720 | 11,000 | 3.50 |
| 6 | 72 | 28 | a | 400 | 600 | 840 | 10,300 | 3.85 |
| 7 | 71 | 29 | a | 400 | 600 | 890 | 10,200 | 4.00 |
| | | | b | 400 | 350 | 750 | 10,000 | 2.98 |
| 8 | 70 | 30 | a | 400 | 500 | 940 | 10,000 | 4.15 |
| | | | b | 400 | 400 | 830 | 9,000 | 3.34 |
| 9 | 69 | 31 | a | 400 | 400 | 1,000 | 9,700 | 4.18 |
| | | | d | 400 | 600 | 1,150 | 11,000 | 4.78 |
| 10 | 68 | 32 | a | 400 | 400 | 1,080 | 9,800 | 4.20 |
| | | | b | 400 | 350 | 980 | 9,200 | 3.95 |
| | | | c | 420 | 300 | 540 | 9,000 | 2.91 |
| | | | d | 400 | 600 | 1,200 | 11,000 | 5.00 |
| 11 | 67 | 33 | a | 400 | 400 | 1,150 | 9,300 | 4.18 |
| | | | b | 400 | 300 | 1,030 | 9,300 | 3.85 |

TABLE 1-continued

| Specimen No. | Composition (atomic %) Iron | Palladium | Quenching* conditions | Tempering conditions Temp. (°C.) | Time (hours) | Magnetic characteristics Coercive force, $H_c$ (Oe) | Residual magnetic flux density, Br (G) | Maximum energy product, (BH) max (Mg.Oe) |
|---|---|---|---|---|---|---|---|---|
| | | | c | 420 | 220 | 650 | 9,000 | 2.50 |
| 12 | 66 | 34 | a | 400 | 380 | 1,200 | 9,000 | 4.20 |
| | | | b | 400 | 500 | 1,080 | 9,000 | 3.17 |
| | | | d | 400 | 600 | 1,350 | 10,800 | 5.65 |
| 13 | 65 | 35 | a | 400 | 500 | 1,100 | 8,600 | 3.90 |
| | | | b | 400 | 300 | 1,000 | 8,400 | 3.71 |
| | | | c | 420 | 200 | 720 | 8,400 | 3.00 |
| | | | d | 400 | 600 | 1,370 | 9,000 | 4.78 |
| 14 | 64 | 36 | a | 400 | 500 | 1,000 | 8,000 | 3.62 |
| | | | c | 420 | 200 | 850 | 7,600 | 2.87 |
| 15 | 63 | 37 | a | 400 | 600 | 870 | 7,000 | 2.50 |
| | | | b | 400 | 400 | 800 | 7,000 | 2.30 |
| | | | c | 420 | 300 | 700 | 7,000 | 2.20 |
| | | | d | 400 | 700 | 1,000 | 7,600 | 4.00 |
| 16 | 60 | 40 | a | 420 | 500 | 750 | 6,000 | 1.80 |
| | | | b | 420 | 450 | 750 | 6,000 | 1.72 |
| | | | c | 420 | 350 | 600 | 5,600 | 1.41 |
| 17 | 57.5 | 42.5 | a | 430 | 600 | 270 | 5,200 | 0.30 |

*a: water quenching;
b: air quenching;
c: slow cooling at 400° C./hour;
d: wire drawing after water quenching As pointed out in the foregoing, the inventor have carried out tests on ternary iron-palladium-silver alloys, to reduce the concentration of costly palladium in the binary iron-palladium alloy while ensuring excellent magnetic characteristics. Silver hardly forms a solid solution with iron but almost thoroughly dissolves in a solid solution with palladium.

Details of the studies and experiments on the ternary iron-palladium-silver alloys will now be described.

As starting materials, electrolytic iron of 99.9% purity, palladium, and silver were used. To prepare specimens for experiments, each of the starting materials was weighed so as to produce 10 grams of each specimen with a desired chemical composition, and each of the specimens thus weighed was placed in an NC Tammann tube. Each specimen was melted in a Tammann furnace while blowing argon gas thereto and stirred thoroughly to get a homogeneous molten alloy, and the alloy was sucked into a quartz tube of about 3.5 mm diameter. A 30 mm long test piece of each specimen was cut from each of the round rods thus formed by the quartz tube, which test piece was heated at 600° C. to 1,200° C. for 10 minutes to one hour and subjected to water quenching and then tempered.

Figure 6:
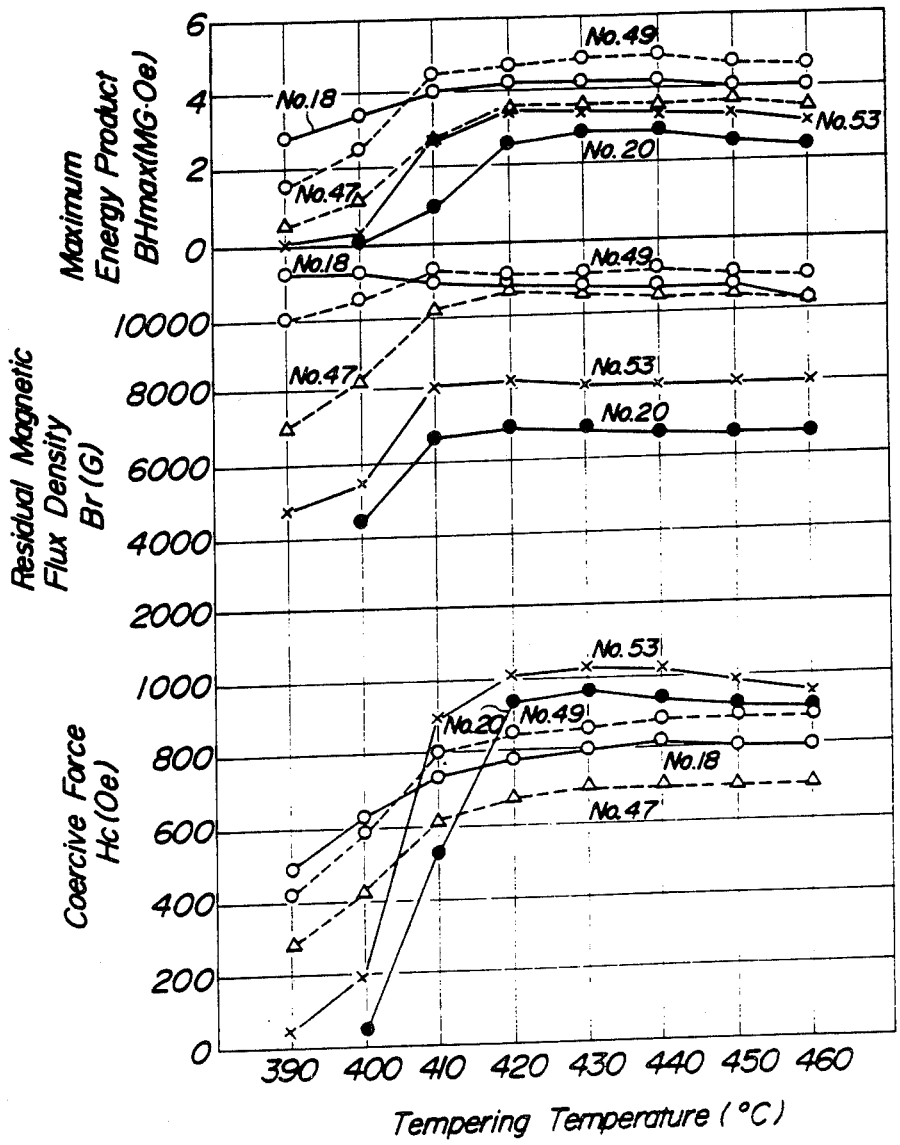
FIG. 6 is a graph showing the relationship between tempering temperatures and magnet characteristics of several specimens of iron-palladium-silver alloy to be used in the present invention.

Alloys of five specimens of different chemical compositions thus heat treated, i.e., Specimens No. 18, No. 20, No. 47, No. 49, and No. 53 (for the chemical compositions, see Table 2), were tempered for 20 hours at different temperature between 390° C. to 460° C. FIG. 6 shows magnetic characteristics of the five specimens thus tempered. As can be seen from the characteristic curves, the coercive force varied considerably depending on the chemical compositions of the alloys but the coercive force increased with the tempering temperature when the tempering temperature exceeded 390° C. until reaching maximum values at tempering temperatures of about 430° C. to 440° C. The coercive force generally decreased as the tempering temperature exceeded that for the maximum coercive force. Thus, according to the present invention, the alloys were tempered for 30 minutes to 2,000 hours in a temperature range of 350° C. to 550° C. suitable for generating fine grain dispersion in $\alpha+\gamma_1$ phase of a mother matrix, so that, fine dispersion of $\alpha+\gamma_1$ phase can be produced in the alloys and permanent magnets with a high coercive force can be obtained. If the aforementioned tempering is effected for a long period at a comparatively low temperature for initial stage of grain dispersion, the coercive force of the permanent magnet can be further improved.

Figure 7:
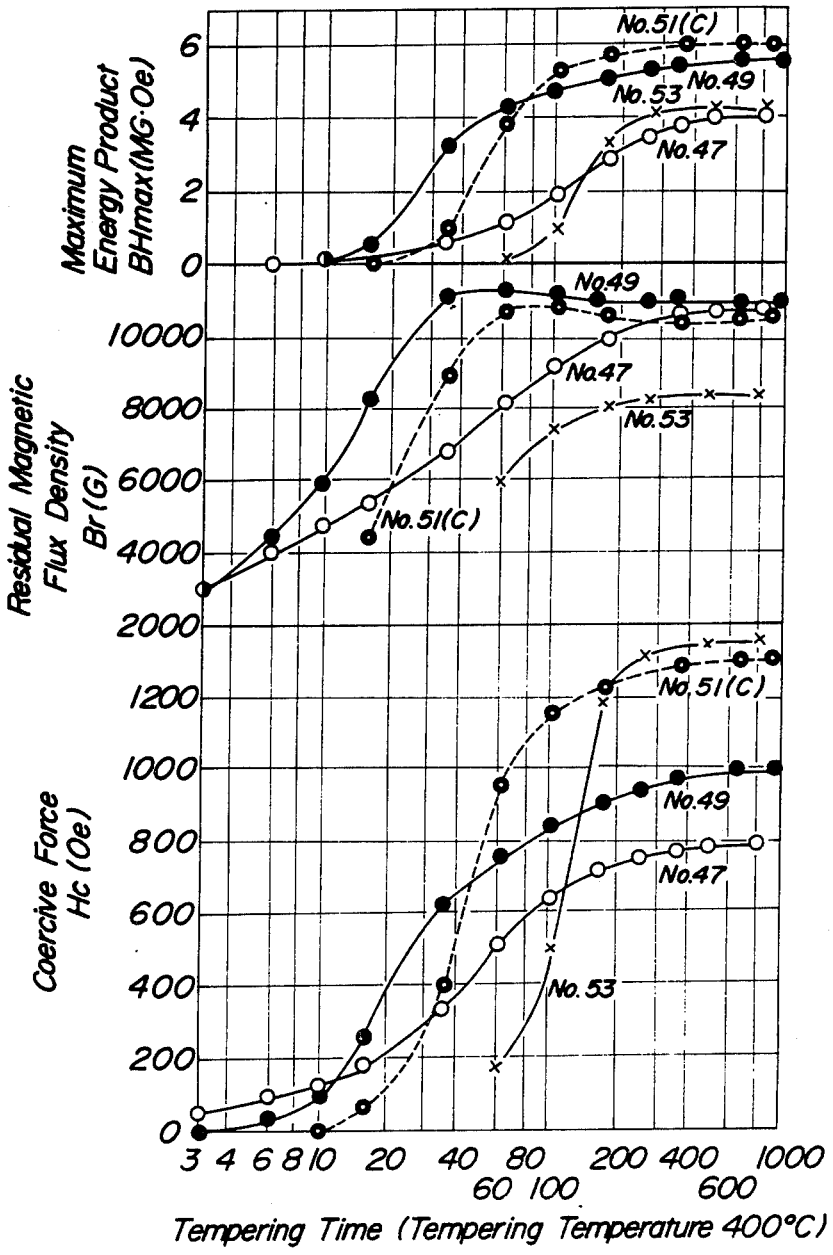
FIG. 7 is a graph showing the relationship between duration of tempering at a constant temperature 400° C. and magnet characteristics of several specimens of the iron-palladium-silver alloy to be used in the present invention.

Alloys of four specimens of typical chemical compositions of the ternary iron-palladium-silver system, i.e., Specimens No. 47, No. 49, No. 51 (c: subjected to wire drawing after water quenching), and No. 53, were tempered for a long period at a constant temperature of 400° C. FIG. 7 shows the relationship between the duration of the long period tempering and the magnetic characteristics obtained thereby. As can be seen from FIG. 7, for the constant temperature of 400° C., keeping the specimens for about 10 hours merely resulted in a slight increase of the coercive force, while the tempering for 30 to 200 hours resulted in a rapid increase of the coercive force, and the maximum coercive force was produced by a still longer tempering. With specimen No. 53, a high coercive force of up to 1,350 Oe was obtained by heating for 500 hours. It was noted in the experiments that a constant temperature heating at a higher temperature, i.e., at 450° C., produced a maximum coercive force after about 30 hours of heating but the maximum value of the coercive force was 950 Oe and comparatively low.

Figure 8:
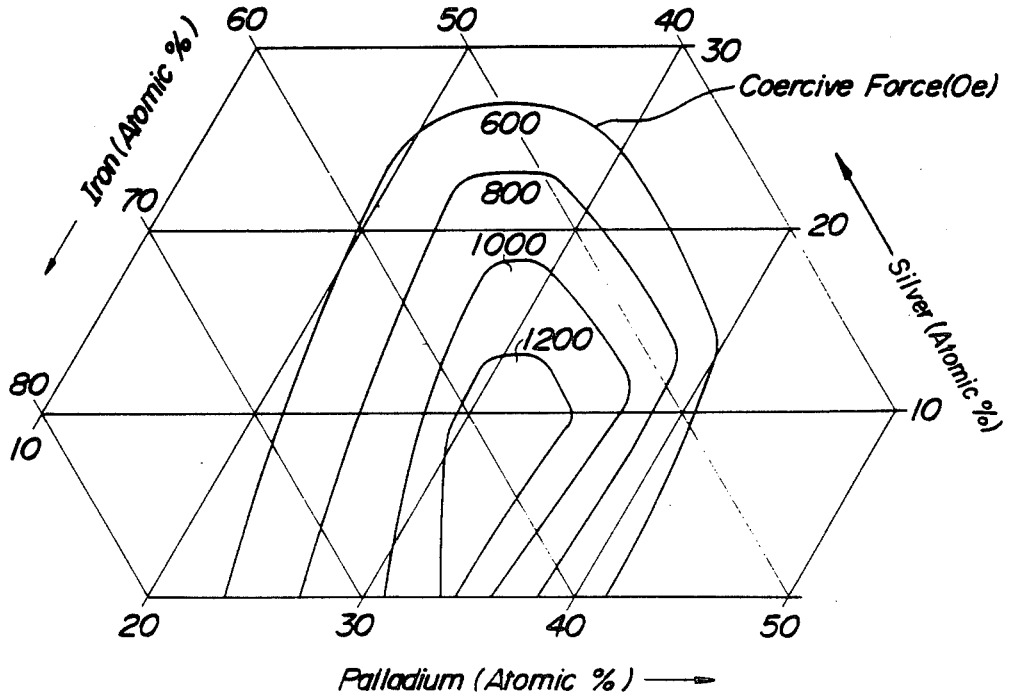
FIGS. 8 to 10 are diagrams showing the relationship between chemical compositions and magnet characteristics of the iron-palladium -silver alloys to be used in the present invention.
Figure 9:
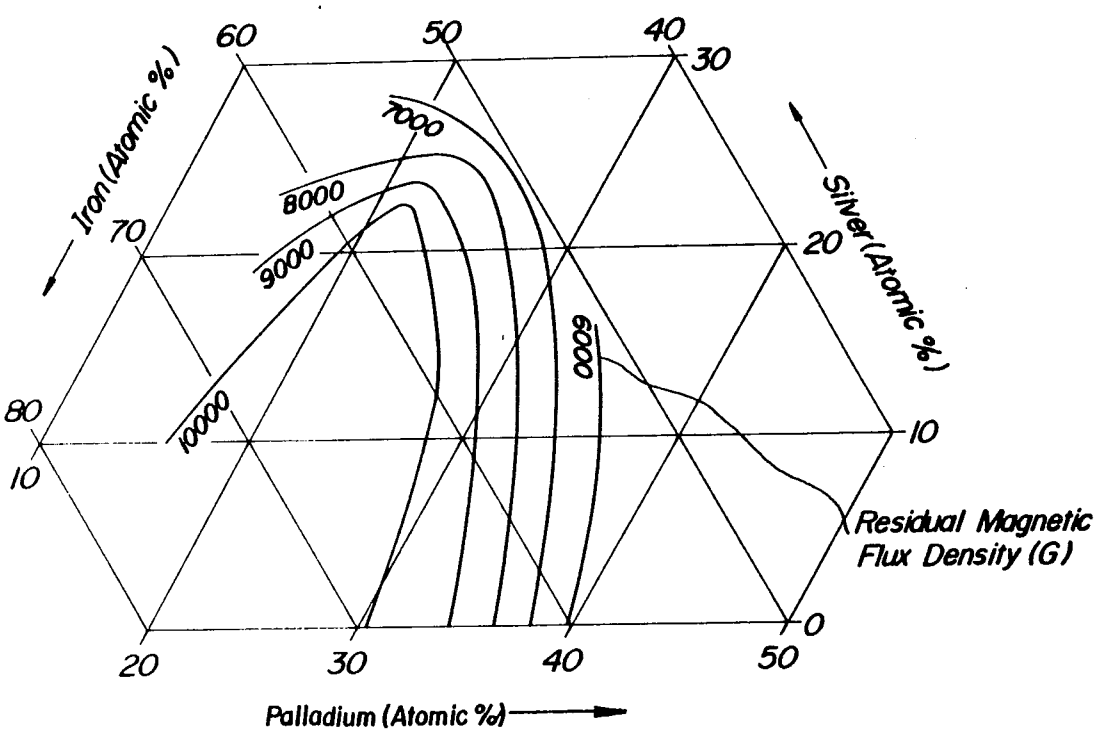
Figure 10:
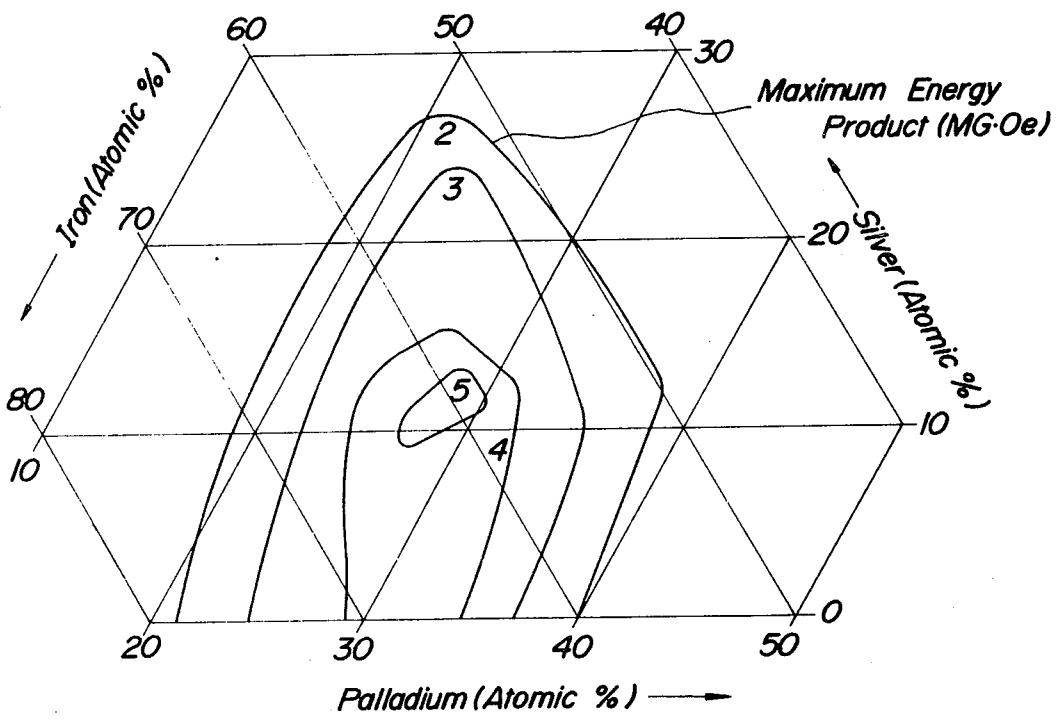

FIG. 8 shows isoplethic curves representing the relationship between chemical compositions of the ternary iron-palladium-silver alloy used in the present invention and the maximum coercive forces of the alloys obtained by the aforementioned various heat treatments. FIGS. 9 and 10 show isoplethic curves representing the residual magnetic flux density and the maximum energy product, respectively, for the aforementioned ternary chemical compositions at the time of the maximum coercive force of FIG. 8. In the case of binary iron-palladium alloy, the composition for producing high coercive forces in excess of 1,200 Oe was limited to a narrow range, but in the case of the ternary iron-palladium-silver alloy, a considerably wide range of compositions produced excellent magnetic characteristics, as can be seen from FIG. 8. When the ternary alloy to be used in the present invention consisted of 56.5 atomic % of iron, 31.5 atomic % of palladium, and 12 atomic % of silver, a maximum coercive force of 1,350 Oe was obtained, and its residual magnetic flux density was 8,400 G and its maximum energy product was 4.18 Mg·Oe. The largest maximum energy product of 5.54 MG·Oe was obtained by a ternary alloy consisting of 59 atomic % of iron, 29 atomic % of palladium, and 12 atomic % of silver, and its coercive force and residual magnetic flux density were 980 Oe and 11,000 G, respectively. Thus, by adding silver in the iron-palladium alloys, the magnetic characteristics of the alloys were further improved.

Table 2 shows the effects of various manufacturing conditions and heat treatments of typical iron-palladium-silver alloy magnet materials on magnetic characteristics produced thereby. As can be seen from Table 2, high-speed quenching in water produced a high coercive force, and even slow cooling at a rate of 400° C./hour produced very good magnetic characteristics. Accordingly, it is noted that, although the magnetic characteristics of regular magnet alloys deteriorate if the magnet alloys are slowly cooled after the homogenizing solid solution treatment thereof, the magnetic characteristics of the ternary alloys used in the present invention are hardly affected by the cooling rate and the practical stability of the magnetic characteristics against temperature variations is very high, which high stability is another excellent property of the ternary alloys used in the present invention.

Table 2 also shows the effects of wire drawing on the magnetic characteristics of the aforementioned ternary alloys; namely, the ternary alloys of Specimens No. 19, No. 35, No. 36, No. 51, No. 53, No. 56, and No. 67 were heated at about 900° C. for one hour, water quenched, subjected to wire drawing at an area reduction ratio of more than about 90%, and then tempered. As can be seen from the table, all the specimens subjected to the wire drawing had improved magnetic characteristics. More particularly, the alloy of Specimen No. 53 showed a maximum coercive force of 1,450 Oe, simultaneously with a residual magnetic flux density of 9,700 G and a maximum energy product of 5.65 MG·Oe. The alloy of Specimen No. 51 provided the largest maximum energy product of 6.02 MG·Oe, and its coercive force and residual magnetic flux density were 1,300 Oe and 10,700 G, respectively. The curves No. 51(c) of FIG. 7 refer to the characteristics obtained by heating the thus wire drawn alloy at the constant temperature.

TABLE 2

| Specimen No. | Composition (atomic %) Iron | Palladium | Silver | Quenching* conditions | Tempering conditions Temp. (°C.) | Time (hours) | Magnetic characteristics Coercive force, $H_c$ (Oe) | Residual magnetic flux density, Br (G) | Maximum energy product, (BH) max (Mg.Oe) |
|---|---|---|---|---|---|---|---|---|---|
| 3 | 68 | 27 | 5 | a | 400 | 550 | 850 | 10,900 | 4.26 |
| 18 | 65 | 27 | 8 | a | 400 | 600 | 920 | 10,700 | 4.24 |
| | | | | b | 380 | 500 | 800 | 10,500 | 3.91 |
| 19 | 61 | 31 | 8 | a | 400 | 650 | 1,240 | 9,200 | 4.53 |
| | | | | b | 380 | 500 | 1,100 | 8,900 | 4.11 |
| | | | | c | 380 | 750 | 1,400 | 10,300 | 5.75 |
| 20 | 55 | 37 | 8 | a | 400 | 600 | 1,050 | 6,700 | 2.87 |
| | | | | b | 380 | 500 | 800 | 6,400 | 2.51 |
| 33 | 62 | 28 | 10 | a | 400 | 600 | 1,020 | 10,500 | 5.05 |
| | | | | b | 380 | 500 | 880 | 10,200 | 4.61 |
| 35 | 60 | 30 | 10 | a | 400 | 600 | 1,230 | 9,400 | 4.50 |
| | | | | b | 380 | 500 | 1,100 | 9,200 | 4.02 |
| | | | | c | 380 | 500 | 1,350 | 9,500 | 5.25 |
| 36 | 58 | 32 | 10 | a | 400 | 700 | 1,300 | 8,200 | 4.52 |
| | | | | b | 380 | 500 | 1,100 | 8,000 | 4.01 |
| | | | | c | 380 | 600 | 1,400 | 9,200 | 5.48 |
| 45 | 67 | 21 | 12 | a | 400 | 400 | 630 | 10,800 | 3.26 |
| | | | | b | 380 | 500 | 430 | 9,700 | 1.92 |
| 47 | 64 | 24 | 12 | a | 400 | 500 | 780 | 10,800 | 4.03 |
| | | | | b | 380 | 500 | 520 | 9,700 | 2.57 |
| 49 | 61 | 27 | 12 | a | 400 | 650 | 980 | 11,000 | 5.54 |
| | | | | b | 380 | 600 | 750 | 10,300 | 4.51 |
| 51 | 59 | 29 | 12 | a | 400 | 500 | 1,150 | 9,600 | 5.51 |
| | | | | b | 380 | 600 | 1,030 | 9,200 | 4.32 |
| | | | | c | 380 | 750 | 1,300 | 10,700 | 6.02 |
| 53 | 56.5 | 31.5 | 12 | a | 400 | 500 | 1,350 | 8,400 | 4.18 |
| | | | | b | 380 | 600 | 1,180 | 8,000 | 3.77 |
| | | | | c | 380 | 700 | 1,450 | 9,700 | 5.65 |
| 56 | 52 | 36 | 12 | a | 400 | 500 | 1,020 | 6,000 | 2.47 |
| | | | | b | 380 | 600 | 970 | 5,800 | 2.35 |
| | | | | c | 380 | 800 | 1,250 | 7,000 | 3.11 |
| 67 | 57 | 28 | 15 | a | 400 | 400 | 1,030 | 9,200 | 3.92 |
| | | | | b | 380 | 600 | 950 | 8,800 | 3.51 |
| | | | | c | 380 | 600 | 1,280 | 11,000 | 5.67 |
| 72 | 55 | 27 | 18 | a | 400 | 400 | 1,000 | 8,800 | 3.41 |
| | | | | b | 380 | 600 | 1,150 | 9,500 | 4.23 |
| 81 | 55 | 22 | 23 | a | 400 | 400 | 720 | 9,200 | 3.04 |

Figures 11A, 11B:
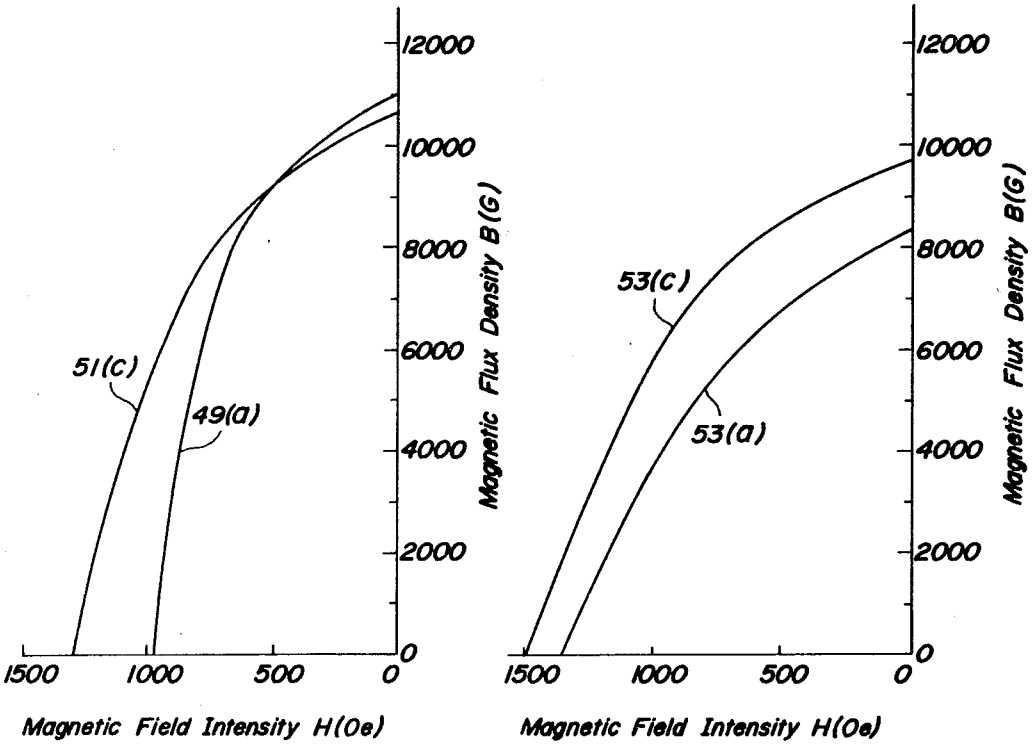
FIGS. 11A and 11B are graphs of demagnetizing curves showing the relationship between magnetic field intensities and magnetic flux densities of several specimens of the iron-palladium-silver alloy to be used in the present invention.

*a: water quenching;
b: slow cooling at 400° C./hour;
c: wire drawing after water quenching FIG. 11A shows demagnetizing curves of the alloys of Specimens No. 49 (a: subjected to water quenching) and No. 51 (c: subjected to wire drawing after water quenching), while FIG. 11B shows demagnetizing curves of the alloys of Specimen No. 53 after water quenching and after wire drawing, respectively. It is apparent from the aforementioned results that the iron-palladium-silver alloys used in the present invention are easy to work and particularly suitable for small magnets of complicated shape.

The method of making a ternary alloy magnet of the present invention will now be described.

A mixture of the starting materials consisting of 19.5 to 41 atomic % of palladium, 0.1 to 27.5 atomic % of silver, and the remainder substantially consisting of iron is melted in air, in an inert gas, or in vacuo and is stirred thoroughly so as to get a molten alloy with a homogeneous compositon, and the molten alloy is formed into a sound cast good by pouring it into a mold of suitable shape and suitable size or by sucking it into a quartz tube, and then the cast good is worked into a desired shape by forging or by drawing. The thus shaped alloy is subjected to homogenizing solid solution treatment for a suitable period at 600° C. to 1,200° C. and is quickly cooled in water or in air or slowly cooled in a furnace. The thus cooled alloy is finally tempered at a temperature in a range of 350° C. to 550° C., so as to obtain a high coercive force.

In an embodiment of the present invention, after the aforementioned homogenizing solid solution treatment, the alloy of the aforementioned composition was quickly cooled in water or in air, subjected to wire drawing with an area reduction ratio of more than 90%, and then tempered at 350° C. to 550° C., so as to provide an easily workable alloy magnet having excellent magnet characteristics.

In the chemical composition of the binary iron-palladium alloy used in the present invention, the concentration of palladium in the binary alloy is limited to 25 to 40 atomic %, because the chemical composition thus limited produces the aforementioned excellent magnet characteristics such as the very high coercive force of 1,350 Oe, while chemical compositions outside the aforementioned limit result in less favorable magnet characteristics which are comparable with values obtained by Kussmann et al regardless of various treatments applied thereto.

Figure 12:
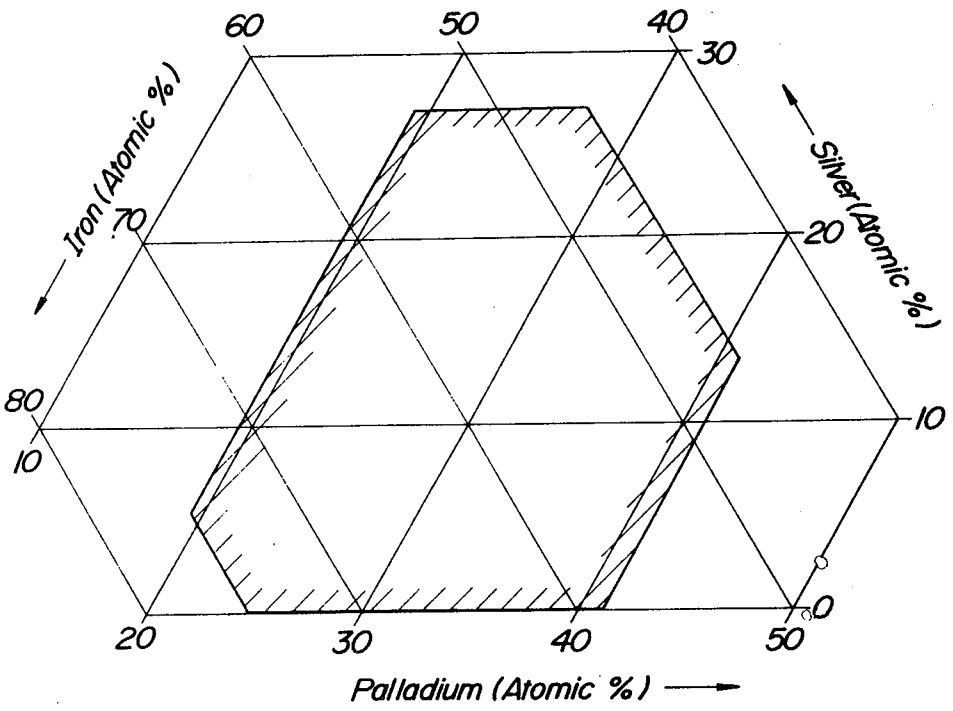
FIG. 12 is a chemical composition diagram wherein a shaded area represents the range of chemical composition of the iron-palladium-silver alloy to be used in the present invention.

In the chemical composition of the ternary iron-palladium-silver alloy used in the present invention, the concentrations of the constituent elements are retricted to 19.5 to 41 atomic % of palladium, 0.1 to 27.5 atomic % of silver, and the remainder of iron with less than 0.5 atomic % of impurities, as indicated by a shaded area in the composition diagram of FIG. 12 The reason for this limitation is that the thus limited chemical composition produces the very high coercive force of up to 1,450 Oe, while alloys having chemical compositions outside the aforementioned limit result in less favorable magnet characteristics regardless of various treatments applied thereto.

The reasons for limiting the temperature of homogenizing solid solution treatment and the tempering temperature in processing the ternary alloy used in the present invention are as follows. The temperature for homogenizing solid solution treatment is restricted to 600° C. to 1,200° C., because the alloy solidified from a melt having a chemical composition usable in the present invention cannot be dissolved into a homogeneous solid solution by heating at a temperature lower than 600° C. or at a temperature higher than 1,200° C. The temperature for tempering the alloy thus treated by the homogenizing solid solution treatment is limited to 350° C. to 550° C., because any tempering at a temperature below 350° C. or at a temperature higher than 550° C. cannot produce the fine grain dispersion of $\alpha$ phase and $\gamma_1$ phase in the mother matrix.

As described in the foregoing, the binary iron-palladium alloy and the ternary iron-palladium-silver alloy to be used in the present invention provide easily workable magnet having excellent magnet characteristics, and the ternary alloy is less costly than the binary alloy. The present invention also provides a method for producing the aforementioned easily workable magnet with excellentmagnet characteristics.

What is claimed is:

1. An easily workable high-coercive-force permanent magnet having a large maximum energy product, wherein the permanent magnet consists of 19.5 to 41 atomic % of palladium, 0.1 to 27.5 atomic % of silver, and the remainder of iron with less than 0.5 atomic % of impurities, and the permanent magnet has a crystalline structure with fine grain dispersion of $\alpha$ phase and $\gamma_1$ phase in a matrix.

2. A very easily workable permanent magnet as set forth in claim 1, wherein the permanent magnet consists of 22.5 to 41 atomic % of palladium, 0.1 to 27.5 atomic % of silver, and the remainder of iron with less than 0.5 atomic % of impurities.

3. A method of producing an easily workable high-coercive-force permanent magnet having a large maximum energy product, comprising melting an alloy consisting of 19.5 to 41 atomic % of palladium, 0.1 to 27.5 atomic % of silver, and the remainder of iron with less than 0.5 atomic % of impurities, solidifying a melt of said alloy to form a shaped article, subjecting said shaped article to homogenizing solid solution treatment by heating at 600° C. to 1,200° C. cooling it quickly or slowly, and then heating it at 350° C. to 550° C. for a period of 30 minutes to 2000 hours for tempering, and cooling so as to generate fine grain dispersion of $\alpha$ phase and $\gamma_1$ phase in a matrix.

4. A method of producing a very easily workable high-coercive-force permanent magnet, comprising melting an alloy consisting of 22.5 to 41 atomic % of palladium, 0.1 to 27.5 atomic % of silver, and the remainder of iron with less than 0.5 atomic % of impurities, solidifying a melt of said alloy to produce a shaped article, subjecting said shaped article to homogenizing solid solution treatment at 600° C. to 1,200° C., cooling it at a cooling rate of 2,000° C./sec to 10° C./hr, subjecting it to wire drawing with an area reduction ratio of more than 80%, and then heating it at 350° C. to 550° C. for 30 minutes to 2,000 hours and cooling it at a cooling rate of 2,000° C./sec to 10° C./hr, so as to generate a crystalline structure with fine grain dispersion of $\alpha$ phase and $\gamma_1$ phase in a matrix.

* * * * *